US005667323A

United States Patent [19]

Whaley

[11] Patent Number: 5,667,323

[45] Date of Patent: Sep. 16, 1997

[54] ARCH RING BINDER ASSEMBLY

[75] Inventor: Paul Whaley, Bonne Terre, Mo.

[73] Assignee: U.S. Ring Binder Corp., New Bedford, Mass.

[21] Appl. No.: 414,207

[22] Filed: Mar. 31, 1995

[51] Int. Cl.[6] ..... B42F 13/36

[52] U.S. Cl. ..... 402/26; 402/70; 402/73

[58] Field of Search ..... 402/26, 31, 70–77

[56] References Cited

U.S. PATENT DOCUMENTS

| | | | |
|---|---|---|---|
| 2,099,472 | 11/1937 | Emery | 402/74 X |
| 2,323,285 | 6/1943 | Trussell | 402/73 |
| 3,183,913 | 5/1965 | Frodermann | 402/31 |
| 3,606,557 | 9/1971 | Schade | 402/31 |
| 3,717,416 | 2/1973 | Schade | 402/31 |
| 3,748,051 | 7/1973 | Frank | 402/75 |
| 3,950,107 | 4/1976 | Seaborn | 402/75 X |
| 4,405,250 | 9/1983 | Wu | 402/64 X |
| 5,035,526 | 7/1991 | Cooper et al. | 402/75 |
| 5,209,593 | 5/1993 | Ros | 402/73 X |

FOREIGN PATENT DOCUMENTS

| | | | |
|---|---|---|---|
| 000620126 | 10/1994 | European Pat. Off. | 402/26 |

*Primary Examiner*—Frances Han

*Attorney, Agent, or Firm*—Polster, Lieder, Woodruff & Lucchesi

[57] ABSTRACT

A binder (12) for storing sheets (S) of paper having punched holes (H). First and second end leafs (16, 18) form outer covers of the binder. A center plate (20) is positioned intermediate the end leafs which are flexibly attached (at **16*f*, 18*f*) to the center plate to enclose sheets of paper between the end leafs. Binder rings (24, 26, 28) carrier on the center plate hold the sheets and are movable from a closed to an open position. Sheets are inserted into the binder by inserting the holes over an exposed end (24*e*, 26*e*, 28*e*) of the rings when the rings are opened. Locking mechanism (30) locks the rings closed. A mechanism (58) moves the rings from their closed to their open position. One end (24*d*, 26*d*, 28*d*) of the rings attach to a rotatable plate (60**). The locking mechanism is located on one side of the center plate adjacent one of the end leafs, and the rotatable plate is located on the opposite side thereof adjacent the other end leaf. The plate pivotally moves in one direction with respect to the locking mechanism to open the rings and in the opposite direction to close them. Substantial quantities of paper are stored in the binder without the rings inadvertently opening became of the quantity of paper stored.

24 Claims, 5 Drawing Sheets

22a
56
68

22b
56
68

22c
56
68

22d
56
68

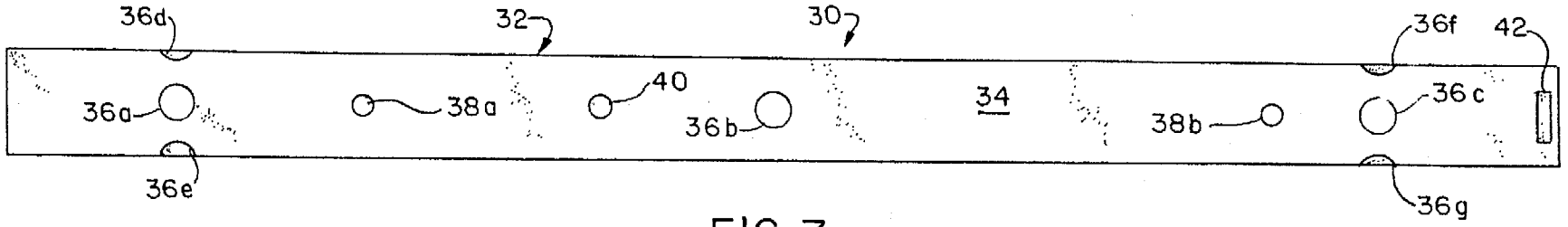
FIG. 7
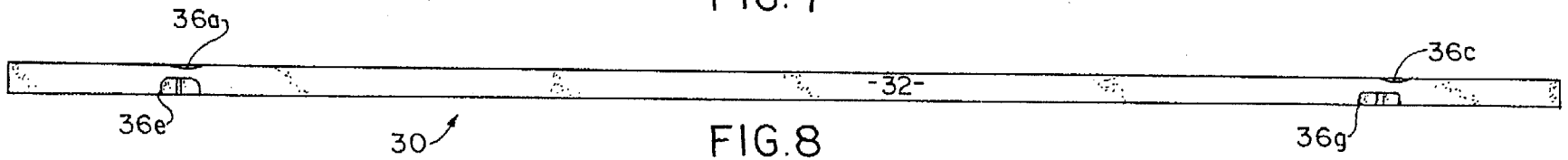
FIG. 8
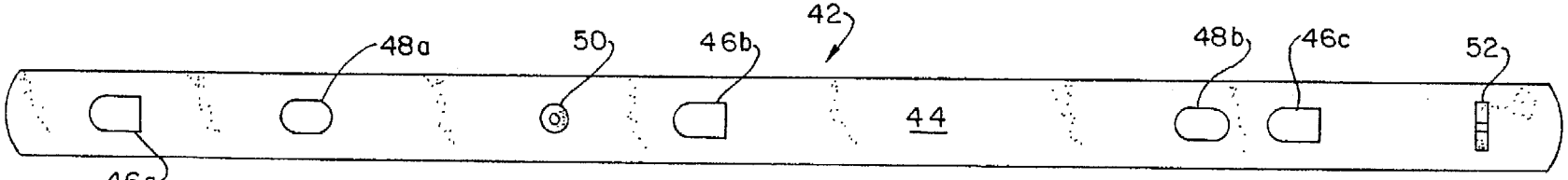
FIG. 9
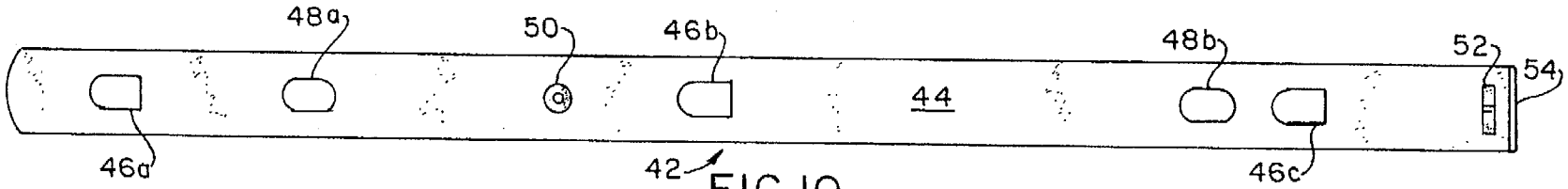
FIG. 10
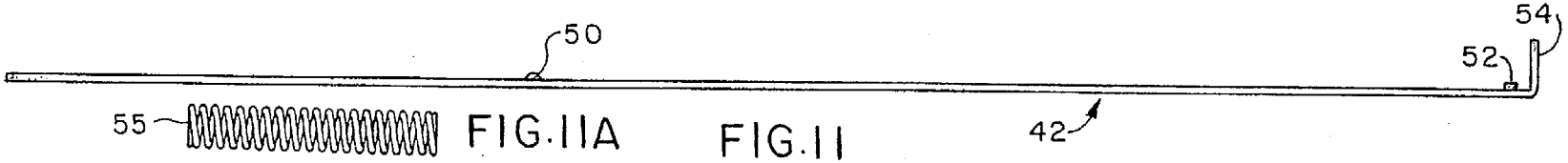
FIG. 11
FIG. 11A

ARCH RING BINDER ASSEMBLY

BACKGROUND OF THE INVENTION

This invention relates to binders such as ringbinders used to hold sheets of paper and other similar material in which holes are punched, and more particularly to a ring binder assembly for use in such ringbinders.

As is well-known in the art, ringbinders are typically used to hold and store punched sheets of paper; although, other suitably punched materials can also be held in a ringbinder. While smaller size ringbinders are used by school students, for example, other applications are for professional or business usage. Here larger size ringbinders; i.e., those designed to hold quantities of paper three inches to six inches thick, are used to store catalog information sheets for retail stores. Or, they can be used to hold specification "spec" sheets which contain a variety of product and performance information about a particular product. In an auto parts or appliance repair stores, for example, there is a constant influx of information on new products, changes to existing products, updated price lists, etc. It is not uncommon in these situations for the volume of paper stored in a ringbinder to soon become very thick. Further, when sheets are removed from a ringbinder to make way for new information sheets, the old sheets are not necessarily discarrier, but rather are stored for possible future reference. Again, the volume of such sheets stored in a ringbinder for this purpose soon becomes very large.

Conventional ringbinders typically have two or three binder rings each of which comprises two separate arcuate segments whose outer ends are in contact with each other when the binder is closed. When a reasonable amount of paper is stored in the binder, the binder is easily kept closed. However, when the mount of paper exceeds a certain amount, it becomes more difficult to keep the binder tightly closed. Rather, the excess paper tends to pull on the respective binder segments forcing them slightly apart. This condition is commonly referred to as "sponginess". Because the information usually stored in a binder must be readily accessed, when new sheets arrive, they most probably are added to an existing binder, rather than a new ringbinder being used with some of the sheets being transferred from the old ringbinder to the new. This especially true where binders are labeled or otherwise marked with the range of information they contain. Often there might not be time to reorder and relabel a series of binders to accommodate all the sheets being stored. A major drawback to this, of course, is that the "spongy" binders open easily, often when not intended. Paper spills, lost temper, poor customer service are all possible results of this condition. Or, because of the way paper folds when the binder is open, it gets increasingly difficult to read the material printed or written at the inner margins of the paper where the pages are held. This also makes it difficult to photocopy or reproduce a page without first removing it from the binder. And because of the large number of pages kept in the binder, a number of pages may have to be removed to facilitate removing the desired page. It would be advantageous therefore to have a binder which not only accommodates a substantial amount of paper, but one which will not readily come open at the wrong time.

SUMMARY OF THE INVENTION

Among the several objects of the present invention may be noted the provision of a binder for use in storing substantial quantities of paper or similar punched materials; the provision of such a binder having a locking mechanism which positively and securely retains all of the material stored in the binder, and does not inadvertently come open as a greater volume of material is stored in it; the provision of such a positive locking mechanism which is easy to open and close but which, when closed, securely captures and holds the material stored in the binder; the provision of such a locking mechanism usable with a wide variety of binders for day-to-day usage as well as archival storage of papers placed in the binder; the provision of such a locking mechanism to provide full page readability of papers stored in a binder; the provision of such a locking mechanism which allows individual pages to be readily copied without first having to remove the pages from the binder; the provision of such a locking mechanism having a standard frame assembly regardless of the size of binder with which the locking mechanism is used; the provision of such a locking mechanism having a low profile design so to not occupy a large portion of binder space; the provision of such a locking mechanism in which the storage capacity of a binder can be increased by replacing an assembly with one binder ring with an assembly having a longer binder ring; the provision of such a locking mechanism which is lockable; the provision of such locking mechanism which allows locking from either the top or bottom of a binder; the provision of such a locking mechanism in which the storage capacity of the binder can be increased in standard increments; the provision of such a binder and locking assembly using component parts readily available from use in other binder constructions; and, the provision of such a locking mechanism which is relatively low cost, and easy to install during fabrication of a binder.

In accordance with the invention, generally stated, a binder is for use in storing sheets of paper having punched holes in them. First and second end leafs respectively form outer covers of the binder. A center plate is positioned intermediate the respective end leafs. One side of each of the end leafs is flexibly attached to opposite sides of the center plate for sheets of paper stored in the binder to be enclosed between the end leafs. A plurality of binder rings are carried on the center plate for holding the sheets. The rings are movable from a closed position to an open position with sheets of paper being inserted into the binder by inserting the holes punched in the sheets of paper over an end of the rings which is exposed when the rings are moved to their open position. A locking mechanism locks the rings in their closed position with the exposed end of the rings being secured in a locked position by the locking mechanism when the rings are closed. A ring moving mechanism is provided for moving the rings from their closed to their open position. One end of the rings is attached to the moving mechanism. The locking mechanism is located on one side of the center plate adjacent one of the end leafs, and the moving mechanism is located on the opposite side of the center plate adjacent the other end leaf. The moving mechanism is pivotally movable in one direction with respect to the locking mechanism to move the one end of the rings from its locked position to its exposed position when the binder is to be opened, and to move the rings in the opposite direction when the binder is to be closed. A substantial quantity of paper can be stored in the binder without the rings being inadvertently opened because of the quantity of paper stored. Other objects and features will be in part apparent and in part pointed out hereinafter.

BRIEF DESCRIPTION OF THE DRAWINGS

FIG. 7 is a top plan view of a channel portion of the locking mechanism;

FIG. 8 is a side elevational view of the channel;

FIG. 9 is plan view of a lockbar used in the in the locking mechanism at one stage of manufacture;

FIG. 10 is a plan view similar to FIG. 9 of the completed lockbar; and,

FIGS. 11–11A are elevational views of the lockbar.

Corresponding reference characters indicate corresponding parts throughout the drawings.

DESCRIPTION OF A PREFERRED EMBODIMENT

Figures 4, 5:
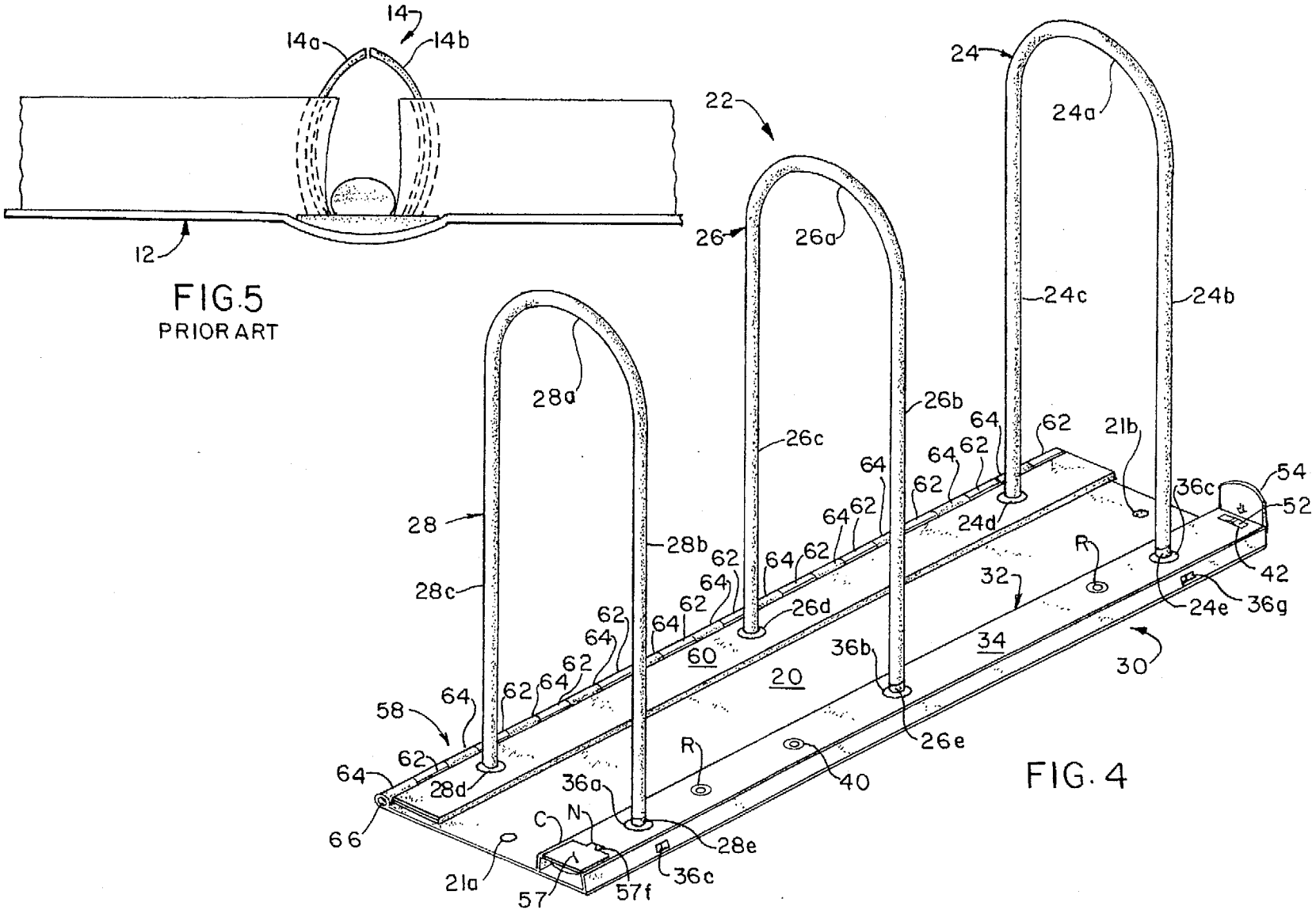
FIG. 5 PRIOR ART
FIG. 4 is a perspective view of a locking mechanism of the binder.
FIG. 5 is an elevation view of a prior art ringbinder illustrating a "spongy" condition of the locking assembly of the binder when it is substantially full of paper.

Referring to the drawings, a binder of the present invention is indicated generally 10. The binder is for use in storing sheets S of paper having punched holes H in them. In particular, binder 10 is for use in storing substantial quantities of paper; for examples, stacks of paper whose cumulative thickness is 3" (7.6 cm.) to 6" (15.2 cm.). This is a thickness of material considerably greater than is conveniently stored in conventional binders. As shown in FIG. 5, one problem with a conventional, prior art type binder 12 is that when a substantial amount of material is stored in the binder, the weight and volume of paper tends to pull the sections 14*a* and 14*b* of a binder ring 14 apart. This makes it easier for the binder to inadvertently come open. An advantage of the binder of the present invention is that the volume of papers is positively secured within the binder, and the binder can be opened only by the action of a person using it.

Figure 2:
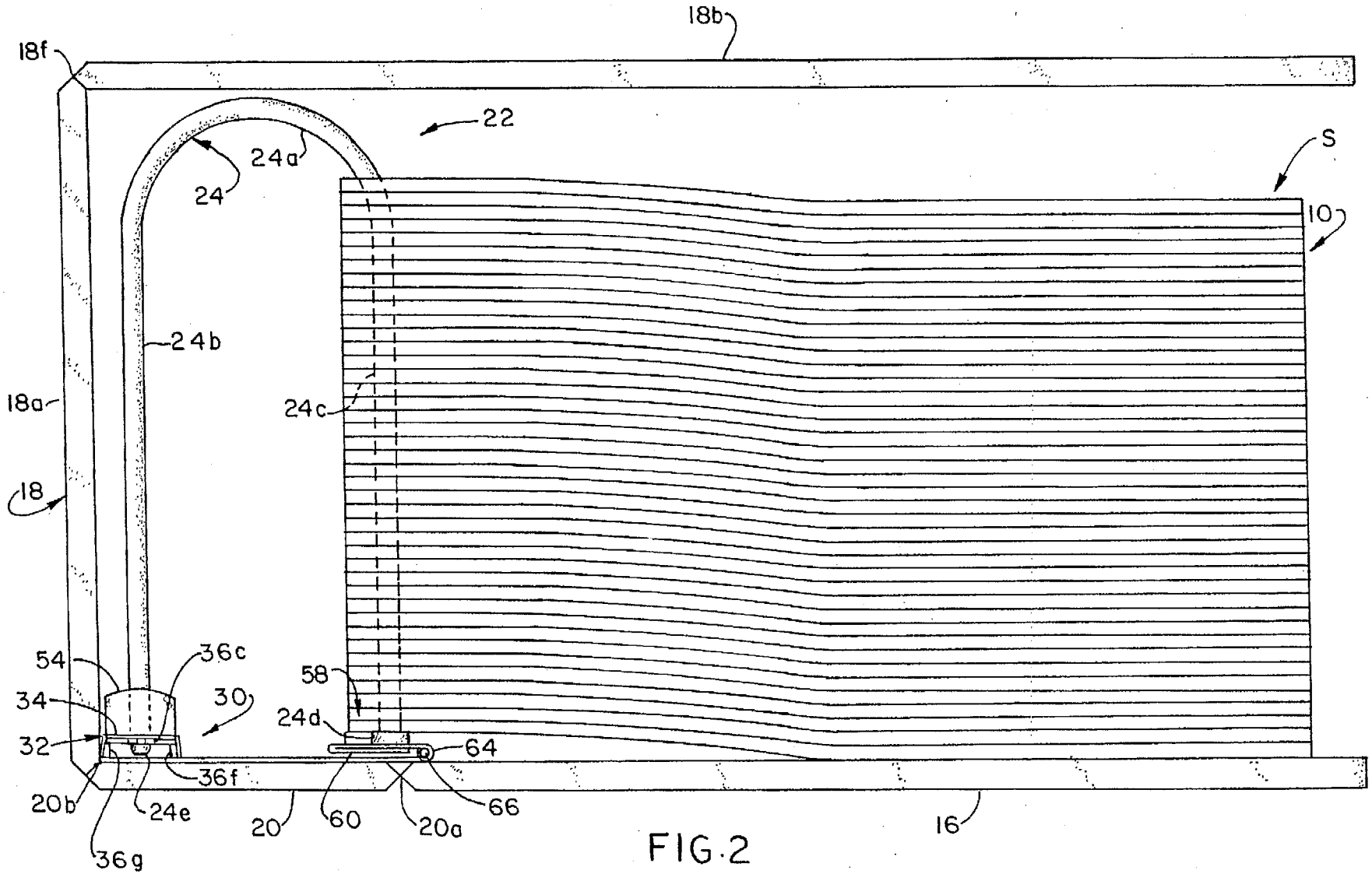
FIG. 2 is an elevational view of the ringbinder in its closed position.

Binder 10 first includes first and second end leafs 16, 18 respectively forming outer covers of the binder. The leafs are generally rectangular in shape and may be made of any suitable material. The length and width of the leafs are a function of the size of paper a particular binder 10 is intended to store. As best shown in FIG. 2, leaf 18 has a fold 18*f* extending longitudinally of the leaf and dividing the leaf into an inner section 18*a* and an outer section 18*b*. The fold allows the outer section of the leaf to be folded over a stack of paper. A center plate is 20 positioned intermediate the respective end leafs. One side of each of the end leafs is flexibly attached to respective opposite sides of the center plate. Plate 20, for example, comprises an elongate or rectangularly shaped metal plate. The end leafs are attached to the center plate in any suitable manner so that a fold 20*a* is formed between the center plate and end leaf 16, and a fold 20*b* is formed between the center plate and end leaf 18. The width of the center plate is a function of the amount of paper intended to be stored in the binder. The height of the plate corresponds to that of end leafs. During fabrication, the end leafs and center plate may be covered in a cloth or other suitable material and may include an embossing (not shown) or other ornamental design. As shown in FIG. 4, openings 21*a*, 21*b* are formed along the longitudinal centerline of plate 20 at respective ends of the plate. These openings are for rivets (not shown), or other means of attachment, to attach the cover plate to the binder assembly during fabrication of the binder.

Figures 1, 3:
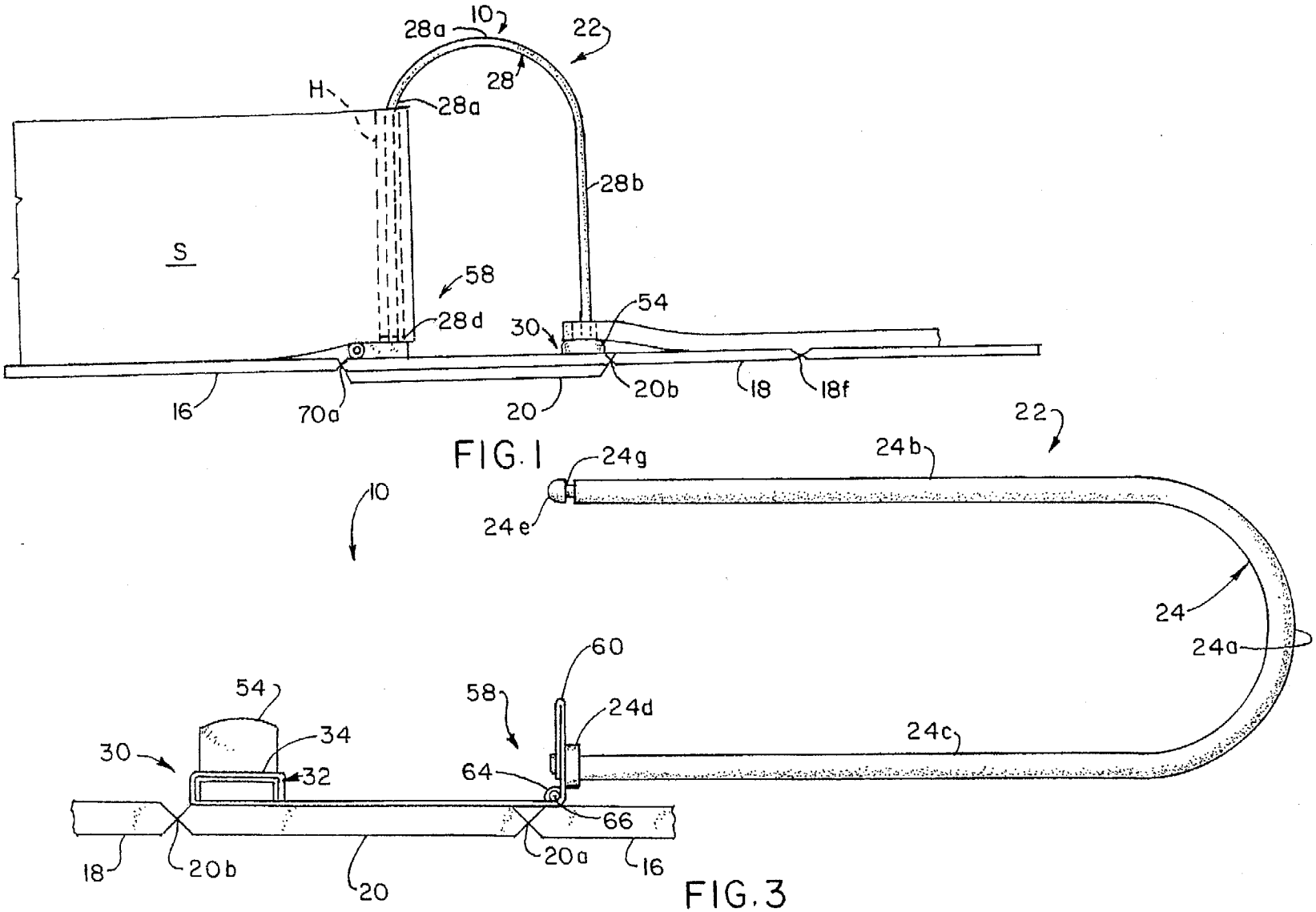
FIG. 1 is an end elevational view of a ringbinder of the present invention in a binder open position.
FIG. 3 is a partial elevational view of the ringbinder in its open position and with a locking mechanism of the binder open for the insertion or removal of paper from the binder.

Next, binder 10 includes a ring means indicated generally 22. The ring means includes a plurality of binder rings which are carried on center plate 20 and which hold sheets of paper. The ring means are movable from a first and closed position as shown in FIGS. 1, 2, and 4, to a second and open position as shown in FIG. 3. Sheets S of paper are inserted into binder 10 by inserting the holes H punched in the respective sheets of paper over an end of the ring means which is exposed when the ring means is moved to its open position shown in FIG. 3.

Ring means 22 includes a plurality of binder rings. In FIG. 4, means 22 is shown to include three binder rings 24, 26, 28. While three such rings are shown in FIG. 4, it will be understood the ring means could include more or fewer rings. Regardless of the number of binder rings, they are spaced along the length of center plate 20. Each binder ring has a central arch shaped section 24*a*, 26*a*, 28*a* respectively. The arch is a generally semi-circular arch the diameter of which generally corresponds to the width of center plate 20. Each binder ring further has respective legs 24*b*, 24*c*, 26*b*, 26*c*, 28*b*, 28*c* respectively extending from the sides of the arch. The legs are of substantially equal length and the length of the legs determine the storage capacity of the binder. An end, 24*d*, for example, of leg 24*c* is secured to a moving means of the binder as described hereinafter. An end, 24*e*, for example, of leg 24*b* is captured and held in place by a locking means of the binder also as described hereinafter. When the binder ring is released from the locking means, a sheet of paper can be inserted into the binder by inserting a respective punched hole in the sheet over the exposed end 24*e* of the binder ring, and up leg 24*b* of the ring.

Figures 6A, 6B, 6C, 6D:
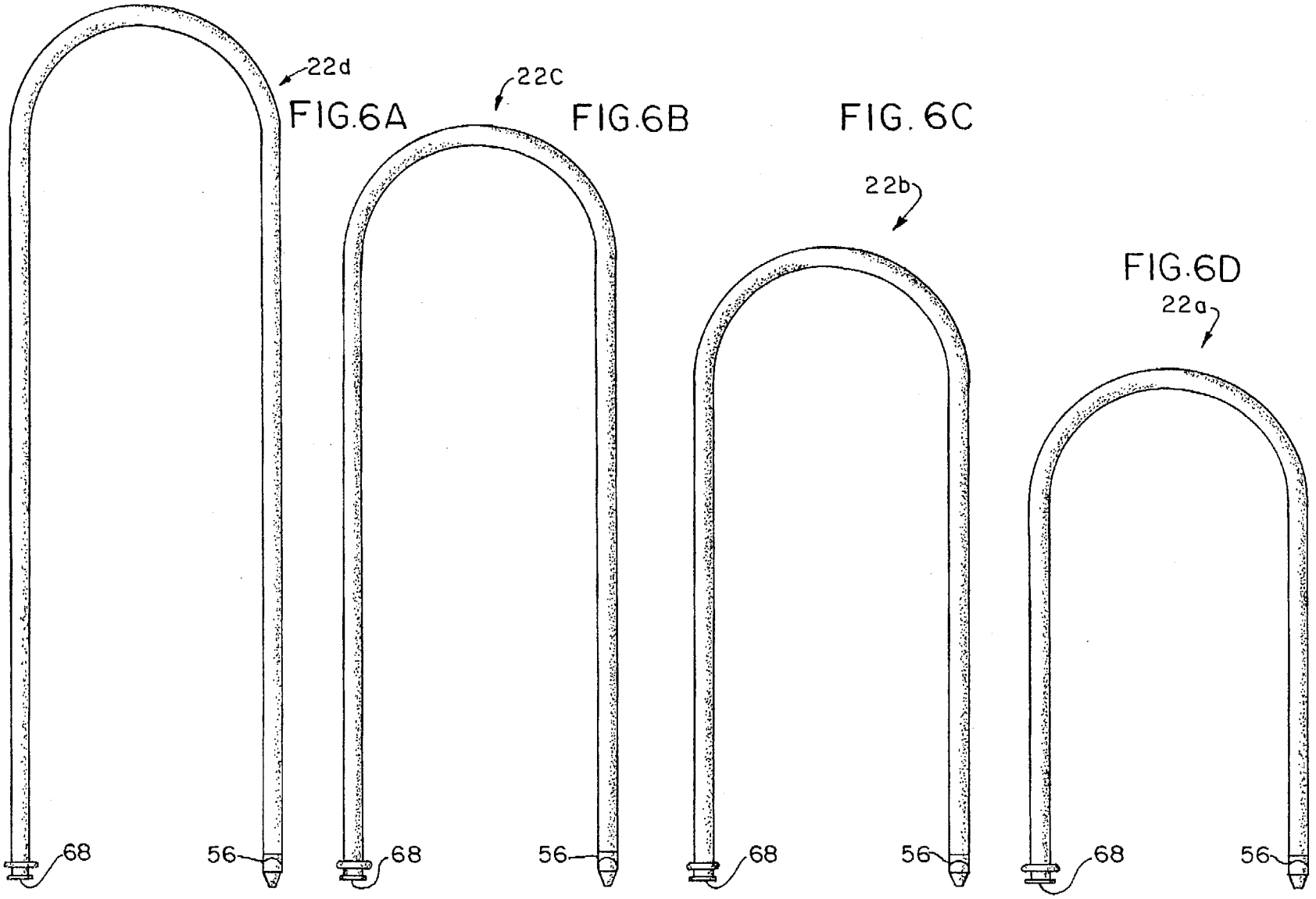
FIGS. 6A–6D are elevational views of a plurality of arched rings which can be used with the binder's locking mechanism for a binder to have different storage capabilities.

Referring to FIG. 6, ring means 22 is shown as including respective sets of rings 22*a*–22*d*. The rings comprising one set of rings has legs of one length while the rings of another set has legs of a different length. By providing these various sets of rings, the storage capacity of binder 10 can be varied in accordance with the set of rings used. In FIG. 6, a ring of set 22*a* is for a binder with a 3" paper storage capacity; while, a ring of set 22*d* is for a binder with a 6" in storage capacity. Rings of respective sets 22*b*, 22*c* provide a binder capacity which is somewhere between these two values.

A locking means 30 is for locking the binder rings in their closed position. Means 30 provides a positive locking of the binder rings by capturing end 24*e*, for example, of ring 24 in a secured, locked position. The locking means first includes means 32 defining a channel. Means 32 comprises a rectangular plate the length of which are formed corresponds to the length of center plate 20. The plate is longitudinally bent along each side of the plate to form a U-shaped channel. Plate 32 then has a center section 34 in which a first set of spaced openings 36*a*–36*c*. There are the same number of openings 36 as there are binder rings used with binder 10. For a three ring binder such as shown in the drawings, hole 36*b* is located in the center of the plate, and holes 36*a*, 36*c* toward the respective ends of the plate. The holes are all centered along the longitudinal axis of the plate. The distance from the center of hole 36*c* to the center of the respective holes 36*a*, 36*c*, corresponds to the distance between the holes H punched in a sheet S of paper stored in the binder. Further, the diameter of the openings corresponds to the diameter of the respective legs of the binder rings. As shown in FIG. 2, end 24e of ring 24 leg 24b is tapered. This allows the end of the leg to fit into the appropriate opening 36. In addition, the length of the respective tapered end corresponds to the height of the channel formed with plate 32. Thus, when the tapered end of the leg is inserted into a respective opening, to lock the ring in its closed position, the end of the leg will not strike the face of center plate 20 to which plate 32 is attached. Respective indentations are formed in the sidewalls of plate 32 at the locations of openings 36a, 36c. These indentations, indicated 36d and 36e, and 36f and 36g, allow flexure of plate 32 at the ends of the plate.

A second set of holes 38a, 38b are formed in plate section 34 intermediate the respective openings 38a, 38c, and 38b, 38c. Theses are holes are for rivets R (see FIG. 4) which are inserted through the openings and mount plate 32, in an inverted position, to plate 20. A pimple hole 40, whose purpose is described hereinafter, is formed in plate section 34 between rivet hole 38a and opening 36b. Finally, an elongate slot 42 is formed adjacent one end of plate section 34. The slot extends transversely of the plate section. In FIG. 7, slot 42 is shown formed in the end of section 34 in which opening 36c is formed.

Next, locking means 30 includes a locking bar 42 which is movable within the channel formed by plate 32 to lock and unlock the ends (24e, 26e, 28e) of the rings. In FIG. 9, bar 42 is shown in an initial stage of manufacture as comprising a rectangular plate 44 the respective ends of which are rounded. A first set of elongate slots 46a, 46b, and 46c are formed in plate 44 at locations corresponding to those of openings 36a–36c in section 34 of plate 32. Slots 46a–46c have a longitudinal axis extending along the centerline of plate 44. All of the slots are similarly formed with one end of each slot being flat, and the other end of the slot being rounded. The respective ends 24e–28e of the binder rings, when inserted through the respective openings 36a–36c in plate section 34, will also extend through one of the respective slots 46a–46c. Next, respective slots 48a, 48b are formed in the plate. Slot 48a is formed between slots 46a, 46b, and slot 48b between slots 46b, 46c. Slots 48a, 48b are positioned in the lock bar for movement with respect to the rivets which extend through plate section 34. This allows movement of the lock bar without interference from the means by which the locking means is secured to center plate 20. A pimple 50 is formed on the upper surface of plate 44. The pimple comprises an upstanding projection which fits into the opening 40 formed in plate section 34. Similarly, a lance 52 is attached to the upper surface of plate 44 adjacent one end of the plate. The lance is rectangular is plan and has length and width measurements sized for the lance to fit through the rectangular opening 42 in plate section 34. As with the pimple, the lance comprises an upstanding projection through the plate section. In FIG. 9, plate 44 is shown to have a substantial length between the position of lance 52 and the adjacent end of the plate. In FIGS. 10 and 11, this end of the plate is bent upwardly at a right angle to the remainder of the plate to form a pad 54 for someone using binder 10 to move the lock bar with their thumb or finger and lock and unlock the binder rings in their closed position.

To assemble locking means 30, locking bar 42 is first slidingly received in the channel formed by plate 32. Bar 42 is installed in the channel so pad 54 projects upwardly from center plate 20 when the locking means is attached to the plate. The locking bar is next moved with respect to the channel until slots 48a, 48b in the locking bar are aligned with openings 38a, 38b in face 34 of plate 32. The locking means is next secured to the center plate using the rivets R. As shown in the drawings, the locking means is secured to center plate 20 along one side of the plate; i.e., adjacent leaf 18 of the binder. With the rivets extending through slots 48a, 48b, the locking is movable back and forth without interference from the rivets. When the locking bar is moved to its position where pad 54 abuts the adjacent end of the channel forming means, locking means 30 is in its locking position. At this time, the flat end of slots 46a–46c are pressed into grooves, such as the groove 24g, formed in the tapered ends of the binder rings (see FIGS. 3 and 4). This contact between the locking bar and ring ends prevents the ring ends from being withdrawn from the locking means. Further in this position, lance 52 on the locking bar fits into the slot 42 in face 34 of the channel defining means to lock bar 42 in place.

When the ring ends are to be released, a downward pressure on pad 54 lowers the end of the lock bar and drops lance 52 out of slot 42. The lock bar can now be pulled outwardly, moving the flat end of slots 46a–46c away from the tapered end of the binder rings. Movement of the lock bar is limited by pimple 50 on the lock bar sliding into the opening 40 in face 34 of the channel defining means. At this position, the slots 46a–46c are centered with respect to the tapered ends of the rings allowing the ring ends to be withdrawn through openings 36a–36c. As shown in the drawings, pimple 50 has a rounded contour. This allows the pimple to be pushed back out of opening 40 when lock bar 42 is re-inserted into the channel toward the ring locking position. To facilitate movement of the lock bar back to its ring locking position, means 30 may further include a spring 56. One end of the spring is secured to the lock bar, and the other end to the underside of face 34 of the channel defining means. Spring 56 then biases locking bar 42 to its locking position. Also, to help move the locking bar to unlock the ends of the ring, a push tab 57 may be mounted in the opposite end of face 34 from pad 54. A cutout C is made in this end of the faceplate, the cutout being generally rectangular but having an inwardly extending notch N along its inner face. Tab 57 is sized to fit in this cutout and has a finger 57f which extends into the notch. The finger is pivotally attached to face 34 so the tab can be moved. To move lock bar 42, once it is unlocked, the user pushes downwardly on the outer end of tab 57. This rotates the tab downwardly against the end of the lock bar pushing the end of the lock bar in the same opening direction it would be pulled by exerting pressure on pad 54. When the lock tab is moved in the locking direction, the end of the lock bar pushes tab 57 upwardly to its original position.

When the ends of rings 24–28 are in their closed position, they extend perpendicular with respect to center plate 20. This is their position even when lock bar 42 is moved to its position unlocking the ends of rings. Binder 10 next includes moving means 58 for moving the rings from a closed position to an open position for the rings. Whereas locking means 30 is located on one side of center plate 20 adjacent end leaf 18, moving means 58 is located on the opposite side of the center plate adjacent end leaf 16. Further, moving means 58 is pivotally movable in one direction with respect to the locking means to move the binder rings from their closed, locked position of FIG. 2 to their position shown in FIG. 3 in which the tapered ends of the ring are exposed so that sheets of paper can be inserted into or removed from the binder. Moving means 58 includes an attachment plate 60 which comprises a rectangular plate having a narrow width and extending lengthwise of center plate 20. Attachment plate 60 hingedly connects to the center plate. Plate 60 has a plurality of spaced knuckles 62 formed along one side of the plate. Center plate 20 correspondingly has a plurality of spaced knuckles 64 formed along the side of the plate to which plate 60 attaches to plate 20. The respective sets of knuckles interfit with each other as shown in FIG. 4. A pintle 66 has a length corresponding to the length of the center plate. The pintle is inserted through the respective sets of knuckles to interlock the center plate and attachment plate along the one side of the center plate. The attachment is now rotatable with respect to the center plate from a position shown in FIGS. 1, 2, and 4 where it rests upon the center plate, partially overlaying the center plate, to its position shown in FIG. 3, where it extends perpendicular to the center plate.

In FIGS. 1–4, leg 24*c*, 26*c*, or 28*c* of the binder rings are each shown to have a flattened base section 24*d*, 26*d*, 28*d*. Plate 60 has respective spaced holes (not shown) formed in it at locations corresponding to the openings 36*a*–36*c* in channel defining means 32. The legs of the respective binder rings are hollow. A rivet 68 (see FIG. 6) is inserted through the underside of plate 60 through the respective openings and into the hollow leg portion of a ring. Once attached to plate 60, the binder rings will rotate with the attachment plate as it moves between its parallel and perpendicular positions relative to center plate 20. With the opposite ends of the rings unlocked, a user of the binder rotates plate 60 and the rings 24, 26, 28 by grasping one of the rings and turning it in the appropriate direction. Once sheets of paper are inserted into or withdrawn from the binder, the user again grasps a portion of a ring and rams it in the opposite direction. As he does so, the ends 24*e*, 26*e*, 28*e* are readily guided into the openings 36*a*–36*c* so the rings can be locked in place.

An attractive feature of the binder and locking assembly construction of the present invention is that many of the component parts used in the apparatus can be adapted from other binder and locking assembly constructions. This not simplifies the design and fabrication of the various component parts, but also reduces inventory costs since one part may be used in different locking apparatus and binder constructions.

What has been described is a binder for use in storing substantial quantities of paper or similar punched materials. The binder includes a locking mechanism which positively and securely retains all of the material stored in the binder. Unlike prior ringbinder locking mechanism constructions, the locking mechanism of the present invention does not inadvertently come apart when larger quantifies of material are stored in the binder. The locking mechanism is a positive locking mechanism which is easy to use to open and close the binder. When closed, material stored in the binder is securely captured and held. The locking mechanism is usable with a wide variety of binders. The binders may be used for day-to-day operations, or for the archival storage of papers. The locking mechanism provides full page readability of papers stored in a binder, and also permits individual pages to be readily copied without having to remove the pages form the binder. The locking mechanism utilizes a standard frame assembly regardless of binder size. Also, the frame assembly is of a low profile design. As such, it does not take up a large mount of binder space. Further, the storage capacity of a binder can be increased by replacing an assembly with one binder ring with an assembly having a longer binder ring. The binder rings are single piece, arched rings which are captured in a locking mechanism of the frame assembly and do not separate from the frame assembly despite large quantities of paper being stored in the binder. The locking mechanism can be arranged for operation from either end of the binder. The locking mechanism permits the storage capacity of a binder to be increased in standard increments. And, the binder and its locking mechanism are relatively low cost, with the locking mechanism being readily installed during fabrication of the binder.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A binder for use in storing sheets of paper having punched holes in them comprising:

first and second end leafs respectively forming outer covers of the binder;

a single-piece center plate positioned intermediate said respective end leafs for one side of each of said end leafs to be flexibly attached to opposite sides of said center plate for sheets of paper stored in said binder to be enclosed between said end leafs;

ring means carried on said center plate for holding sheets of paper, said ring means including a plurality of single piece binder rings, and being movable from a first and closed position to a second and open position, sheets of paper being inserted into said binder by placing the holes punched in the sheets of paper over an end of said ring means which is exposed when said ring means is moved to its open position;

locking means for locking said ring means in its closed position, said locking means being fixedly secured to one side of said center plate adjacent one of said end leafs, and said locking means securing the exposed end of said ring means in a locked position when said ring means is in its closed position; and, moving means for moving said ring means from its closed to its open position, an end of said ring means opposite said exposed end of said ring means being fixedly secured to said moving means, and said moving means being located on the opposite side of said center plate from said locking means and adjacent the other of said end leafs, said moving means being pivotally movable in one direction with respect to said locking means to move the first said end of said ring means from its locked position to its exposed position when said binder is to be opened, and movable in the opposite direction when said binder is to be closed.

2. The binder of claim 1 wherein said center plate comprises an elongate metal plate the length of which corresponds to the height of the binder.

3. The binder of claim 2 wherein said single piece binder rings are spaced along the length of said center plate.

4. The binder of claim 3 wherein each binder ring has a central arch shaped section with equal length legs extending from the respective sides of the arch, the length of the legs determining the storage capacity of the binder.

5. The binder of claim 4 wherein said ring means includes sets of rings with the rings comprising one set thereof having legs of one length and the rings of a second set thereof having legs which are of a different length whereby the storage capacity of said binder can be varied in accordance with the set of rings used.

6. The binder of claim 2 wherein said moving means includes an attachment plate extending lengthwise of said center plate with said one end of each of said rings being secured to said attachment plate.

7. The binder of claim 6 wherein said attachment plate is hingedly connected to said center plate along said side of said center plate where said moving means is located, said attachment plate being rotated to a position where it partially overlays said center plate when moved to said ring closed position.

8. The binder of claim 7 wherein said attachment plate is movable from a position parallel with respect to said center plate when said rings are in their closed position to a position perpendicular to said center plate when said rings are in their fully open position for insertion or removal of sheets of paper from said binder.

9. The binder of claim 8 wherein said locking means includes means defining a channel the length of which corresponds to the height of said center plate, said channel defining means being mounted on said center plate and extending the length thereof.

10. The binder of claim 9 wherein said locking means further includes a locking bar movable within said channel, said locking bar having a plurality of spaced openings therein in which said respective exposed ends of said rings are inserted when said rings are moved to their closed positions, subsequent movement of said locking bar after insertion of said ring ends closing said openings and locking said rings in their closed positions.

11. The binder of claim 10 wherein said locking bar comprises an elongate locking plate slidably received in said channel defining means, one end of said locking plate being bent at an angle with respect to said channel defining means to provide a manually operable tab for moving said locking bar to allow said binder rings to be moved between their open and closed positions respective first and second end covers and a center plate positioned intermediate the respective.

12. The binder of claim 11 wherein further including spring means for biasing said locking bar to its position closing said ring means, said rings being moved to a position perpendicular with respect to said center plate when said rings are moved to their open position.

13. Apparatus for storing sheets of paper having punched holes in them in a binder, the binder including two covers with one side of each cover being flexibly attached to opposite sides of a single-piece center plate for sheets of paper stored in the binder to be enclosed between the covers, the apparatus comprising:

ring means carried on said center plate for holding sheets of paper, said ring means including a plurality of single piece binder rings, and being movable from a closed position to an open position, and sheets of paper being inserted into the binder by placing the holes punched in the sheets of paper over an end of said ring means which is exposed when said ring means is moved to its open position;

means for locking said ring means in its closed position, said locking means being fixedly secured to one side of said center place adjacent one of said covers, and said exposed end of said ring means being secured in a locked position by said locking means when said ring means is in its closed position; and, means for moving said ring means from its closed to its open position, an end of said ring means opposite said exposed end of said ring means being fixedly secured to said moving means, and said moving means being located on the opposite side of said center plate from said locking means and adjacent the other cover, said moving means being pivotally movable in one direction with respect to said locking means to move the first said end of said ring means from its locked position to its exposed position when the binder is to be opened, and movable in the opposite direction when the binder is to be closed thereby to facilitate insertion of papers into the binder for storage and to secure a substantial quantity of paper in the binder without the ring means being inadvertently opened because of the quantity of paper stored therein.

14. The apparatus of claim 13 wherein the binder single-piece center plate comprises an elongate metal plate whose length corresponds to the height of the binder, and said single piece binder rings are spaced along the length of said center plate.

15. The apparatus of claim 14 wherein each binder ring has an arch shaped center section with legs of equal length extending form the respective sides of the arch, the storage capacity of the binder being a function of the length of the legs.

16. The apparatus of claim 15 wherein said moving means includes an attachment plate hingedly connected to said center plate along said side of said center plate where said moving means is located, said attachment partially overlaying said center plate when said rings are in their closed position, and said attachment plate extending lengthwise of said center plate with said one end of each of said rings being secured to said attachment plate.

17. The apparatus of claim 16 wherein said attachment plate is movable from a position parallel to said center plate when said rings are closed to a position perpendicular to said center plate when said rings are moved to their open position.

18. The apparatus of claim 17 wherein said locking means includes means defining a U-shaped channel the length corresponds to that of said center plate, said channel defining means being mounted on said center plate in an inverted position.

19. The apparatus of claim 18 wherein said locking means further includes a locking bar movable within said channel and having a plurality of spaced openings therein in which said respective exposed ends of said rings are inserted when said rings are moved to their closed positions wherein subsequent movement of said locking bar locks said rings in their closed positions, said locking bar comprising an elongate locking plate slidably received in said channel defining means with one end of said locking plate formed at an angle with respect to said channel defining means and providing a manually operable tab for moving said locking bar to allow said binder rings to be moved between their open and closed positions.

20. In a ring binder for storing sheets of paper having punched holes therein, the binder having respective first and second end covers and a single-piece center plate positioned intermediate the covers with one side of each cover flexibly attached to opposite sides of the center plate for sheets of paper stored in the binder to be enclosed between the covers, the improvement comprising a locking mechanism for holding and storing the sheets of paper comprising:

a plurality of binder rings on which said sheets of paper are captured, said binder rings being movable from a closed position to an open position with sheets of paper being inserted into the binder by placing the holes punched in the sheets of paper over ends of said respective binder rings which are exposed when said binder rings are open, each binder ring being a single piece ring having an arch shaped center section with legs of equal length extending from the respective sides of the arch, the storage capacity of the binder being a function of the length of the legs;

means for locking said binder rings in their closed position, said locking means being fixedly secured to one side of said center plate adjacent said first end cover, and said locking means securing said exposed ends of said binder rings in a locked position when said binder rings are in their closed position; and, means for moving said binder rings from their closed to their open position, said moving means located on the opposite side of said center place, adjacent said second end cover, the respective ends of said binder rings opposite said exposed end of said rings means being fixedly secured to said moving means with said moving means being pivotally movable in one direction with respect to said locking means to move said binder rings means from their closed to their open positions when the binder is to be opened, and movable in the opposite direction when the binder is to be closed, papers inserted into the binder for storage being secured therein with a substantial quantity of paper being securable in the binder without the binder rings being inadvertently opened because of the quantity of paper stored therein.

21. The improvement of claim 20 wherein the binder center plate comprises an elongate metal plate whose length corresponds to the height of the binder, said locking means being located on one side of said center plate adjacent one of the covers and said moving means being located on the opposite side of said center plate adjacent the other cover, and said binder rings including a plurality of binder rings spaced along the length of said center plate equidistantly from each other.

22. The improvement of claim 21 wherein said moving means includes an attachment plate hingedly connected to said center plate along one side of said center plate and partially overlaying said center plate when said rings are in their closed position, said attachment plate extending lengthwise of said center plate with said one end of each of said rings secured to said attachment plate, and said attachment plate being movable from a position parallel to said center plate when said rings are closed to a position perpendicular thereto when said rings are moved to their open position.

23. The improvement of claim 22 wherein said locking means includes means defining a U-shaped channel mounted on said center plate in an inverted position and a locking bar movable within said channel, said locking bar having a plurality of spaced openings therein in which respective ends of said rings are inserted when said rings are moved to their closed positions, subsequent movement of said locking bar locking said rings in their closed positions, and said locking bar comprising an elongate locking plate slidably received in said channel with one end of said locking plate being at an angle to said channel to provide a manually operable pad for moving said locking bar to allow said binder rings to be moved between their open and closed positions.

24. The improvement of claim 23 further includes manually operable means carried on said channel defining means for moving said locking bar, said manually operable means including a rotatable pad located on an end of said channel defining means opposite from the end of said channel defining means where said locking bar pad is located for a user of the binder to move said locking bar by pressing on said tab to rotate said pad against said locking bar, the length of said locking bar being such that it extends the length of said channel defining means.

* * * * *